United States Patent [19]

Koike et al.

[11] Patent Number: 5,054,941

[45] Date of Patent: Oct. 8, 1991

[54] PRINT HEAD DRIVING CIRCUIT FOR A WIRE DOT PRINTER

[75] Inventors: Kiyofumi Koike; Minoru Tanaka, both of Suwa, Japan

[73] Assignee: Seiko Epson Corporation, Tokyo, Japan

[21] Appl. No.: 477,380

[22] Filed: Feb. 9, 1990

[30] Foreign Application Priority Data

| | | | |
|---|---|---|---|
| Feb. 10, 1989 | [JP] | Japan | 1-31602 |
| Feb. 13, 1989 | [JP] | Japan | 1-33111 |
| Nov. 6, 1989 | [JP] | Japan | 1-289720 |

[51] Int. Cl.[5] ..... B41J 3/02

[52] U.S. Cl. ..... 400/124; 400/719; 101/93.05; 310/222

[58] Field of Search ..... 400/157.3, 157.2, 719, 400/54, 124 T, 124 C, 124, 470; 346/76 PH; 101/93.05; 310/222

[56] References Cited

U.S. PATENT DOCUMENTS

| | | | |
|---|---|---|---|
| 4,496,824 | 1/1985 | Kawai et al. | 346/76 PH |
| 4,552,064 | 11/1985 | Sanders et al. | 400/124 |
| 4,625,137 | 11/1986 | Tomono | 310/317 |
| 4,661,002 | 4/1987 | Ara | 400/124 |
| 4,664,542 | 5/1987 | Tsugita | 101/93.05 |
| 4,697,939 | 10/1987 | Ara | 400/124 |
| 4,776,712 | 10/1988 | Okuno et al. | 101/93.05 |
| 4,802,776 | 2/1989 | Miyazawa et al. | 400/124 |

*Primary Examiner*—Eugene H. Eickholt
*Attorney, Agent, or Firm*—Blum Kaplan

[57] ABSTRACT

A drive circuit for a wire dot print head including a driving coil, a print lever attracted by the coil in a first direction, a spring for biasing the print lever in a second opposite direction and a damper includes a DC power source connected to a first end of the driving coil. A transistor is connected to the second end of the driving coil. An output circuit provides a gated output to the transistor. The output circuit receives as a first input a print data signal and as a second input a signal from a reference timing signal generator. The reference timing signal generator includes a drive pulse signal generator which provides an output in response to a print timing pulse which causes the output circuit to provide an output for the driving coil to attract the print lever. The reference timing signal generator also includes a brake pulse signal generator which provides an output when the print head temperature falls outside of a predetermined range after a predetermined interval so that current is caused to flow through the driving coil when the print lever is moving in the second direction and the print head temperature falls outside of the temperature range.

16 Claims, 5 Drawing Sheets

PRINT HEAD DRIVING CIRCUIT FOR A WIRE DOT PRINTER

BACKGROUND OF THE INVENTION

This invention relates to a wire dot printer which prints by activating an actuator coil for attracting a print lever and moving a print wire attached thereto and, more particularly, to a circuit for activating the actuator coil within the print head to cause the print lever to move.

In conventional wire dot printer print heads, at least one print lever is movably mounted therein. A print wire is affixed at a distal end of the print lever. An electromagnetic coil provides an attractive force for attracting the lever causing the print wire to strike against the platen. Once printing is completed, the electromagnetic coil may perform a repulsion to repulse the print lever to a return position or a return spring may be mounted within the print head to push the lever to the return direction after printing. Rebounding occurs during the return of the lever to its starting position and, therefore, a damper member made of a highly viscoelastic material, such as rubber, is provided to stop such rebounding.

Such a damper member will sufficiently dampen the rebounding of the wire at room temperature so that the wire and lever will be stopped at the initial starting position, as shown in the solid line of FIG. 6. However, when there is a high print density data to be printed or when the ambient temperature becomes very low, the damper member loses its viscoelasticity. As a result, the rebounding action shown by the wire and lever cannot be sufficiently dampened resulting in the motion illustrated by the dashed line in FIG. 6. Consequently, the print lever which has returned to strike against the damper member during the return movement cannot be sufficiently decelerated so that the wire again moves forward striking the platen performing ghost printing. Additionally, the print wire may be caught on the ribbon during this rebound striking.

Prior art printers which overcome these defects are known from Japanese Laid Open Patent Application No. 61-22761 and Japanese Laid Open Patent Application No. 63-317370 which provide for reenergizing an electromagnetic coil for a short period after completion of the printing to cancel any excessive return or rebound force. However, since the repulsive force acting on the print lever must vary greatly depending on the elasticity of the damper member and, in turn, the elasticity of the damper member varies with the ambient temperature, when the temperature of the print head deviates from an upper and lower predetermined limit, the print wire continues to tend to rebound into an unwanted striking position.

Accordingly, it is desired to provide a print head driving circuit for a wire dot printer which overcomes the shortcomings of the prior art by preventing rebounding of the print wire even when the ambient temperature of the print head falls outside of a predetermined range.

SUMMARY OF THE INVENTION

Generally speaking, in accordance with the invention, a print head driving circuit for driving a print head which includes a print lever upon which a print wire is mounted, a driving coil for acting as an electromagnet for attracting the lever, a spring member for returning the lever to a standby position and a damper member for absorbing the kinetic energy of the lever during the return includes a DC power source connected to one end of the driving coil. A switch is connected to the other end of the driving coil. The output of a gating circuit is connected to the switch. The gate circuit receives a print data signal. A reference timing signal generator also inputs a reference timing signal to the gate circuit. The reference timing signal generated includes a drive pulse signal generator which is actuated by a print timing pulse and produces a pulse having a conduction interval which is necessary to drive the lever and a brake pulse signal generator, which outputs a pulse having a given interval during the return stroke of the lever for a controlled return of the lever when the temperature of the print head falls outside of a predetermined temperature range so that the driving coil attracts the print lever during the return stroke.

Accordingly, it is an object of the invention to provide an improved print head driving circuit for a wire dot printer.

It is a further object of the invention to provide a print head drive circuit which allows a print lever to return to a home position in a proper manner without rebounding regardless of the temperature of the print head, preventing undesired damping action of each print wire while permitting high speed printing.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
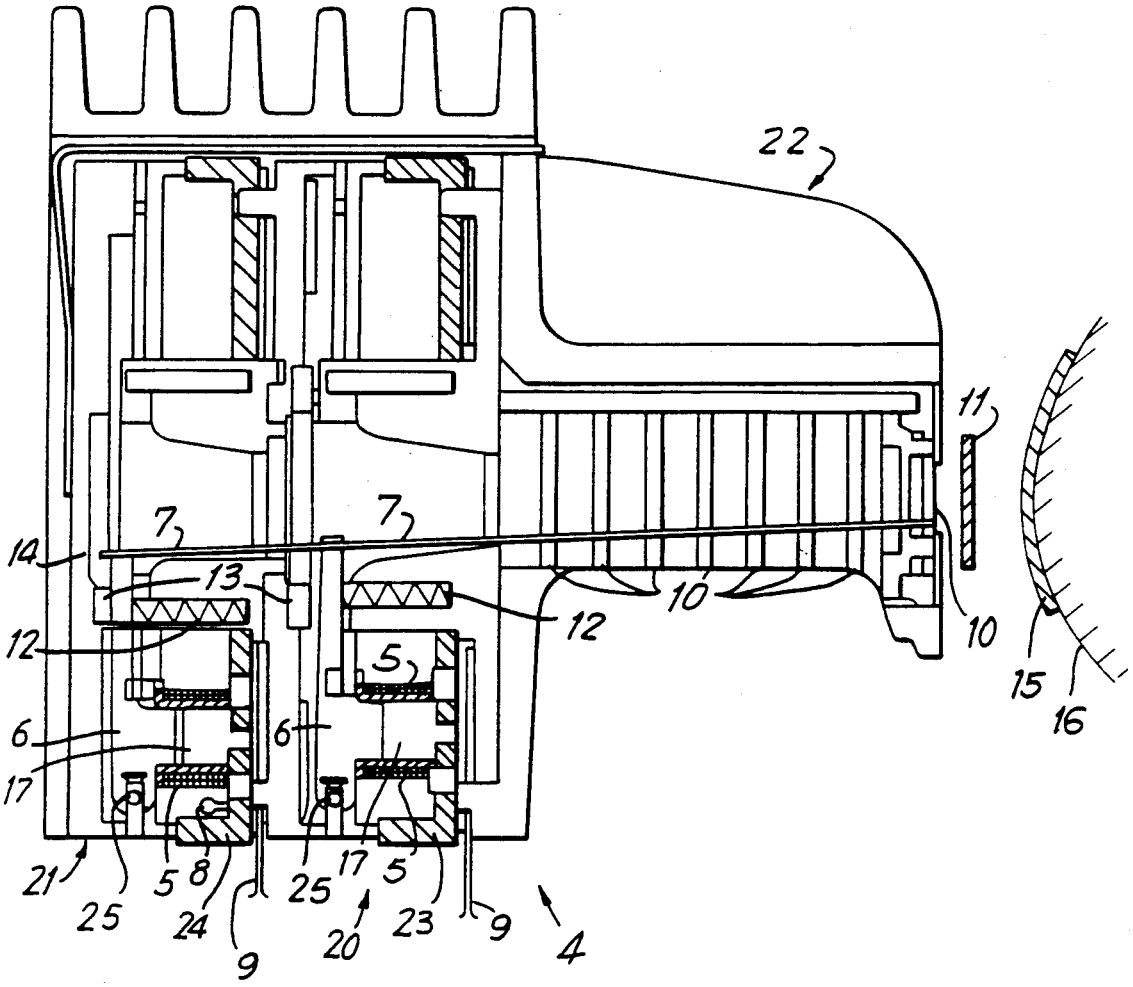
FIG. 1 is a sectional view of a wire dot print head utilized in conjunction with a print head driving circuit constructed in accordance with the present invention.

Reference is first made to FIG. 1, wherein an exemplary embodiment of a high dot density wire dot print head, generally indicated as 4, which is driven by a drive circuit constructed in accordance with the invention, is provided. Print head 4 is positioned adjacent a platen 16. Paper 15 and ink ribbon 11 are disposed between print head 4 and platen 16. Print head 4 includes a first head unit 20 integrally formed with a nose member 22. A second head unit 21 of similar construction to head unit 20 is disposed on head unit 20. Print head unit 20 includes a cup shaped casing 23 made of magnetic material which also serves as a part of the magnetic circuit. A core portion 17 is provided including a plurality of coil cores joined by a circular common portion received in and magnetically coupled to the casing 23, one coil core being provided for each print wire. Similarly, print head unit 21 includes a cup shaped casing 24 made of magnetic material formed with a core portion 17. The structure of casings 23 and 24 are primarily identical and, therefore, for simplicity only casing 23 is described. Each coil core of core portion 17 is provided with a driving coil 5 mounted about the associated core.

A print lever 6 is pivotably mounted within casing 23 by a pin 25 extending from print lever 6. A print wire 7 is affixed at one end of print lever 6. A plurality of guide boards 10 are provided within nose member 22 for guiding print wire 7 as it moves towards and away from platen 16. A return spring 12 is positioned adjacent print lever 6 to provide a force on print lever 6 which urges print wire 7 in a direction away from platen 16. A damper 13, made of rubber or the like, is disposed on the opposed side of print lever 6 from spring 12 to absorb the kinetic energy impulse which occurs when lever 6 is returned by spring 12 to a home position after the completion of printing, preventing the rebounding of print lever 6. A temperature sensor 8, such as a thermistor or the like, for detecting the temperature within the print head is mounted on casing 24 and provides a temperature signal output to be utilized by the driving circuit. A terminal board 9 connects each driving coil 5 to an external driving circuit. A holding member 14 maintains each of these components within respective casings 23 and 24 to form a single unitized body.

Print head 4 is operated by supplying a driving current through terminal board 9 to a driving coil 5. Once energized, driving coil 5 attracts lever 6 with magnetic force which is in opposition to the urging force of spring 12 causing print wire 7 to hammer into platen 16. As print wire 7 is hammered into platen 16, print wire 7 hammers ink ribbon 11 against paper 15 lying between platen 16 and print head 4, creating a dot on printing paper 15. When the driving current is turned OFF after the elapse of a predetermined time period, the urging force of spring 12 quickly turns print lever 6 to its original position. The resulting kinetic energy impulse upon the return movement is absorbed by damper 13 causing print lever 6 to return to its original position.

Figure 2:
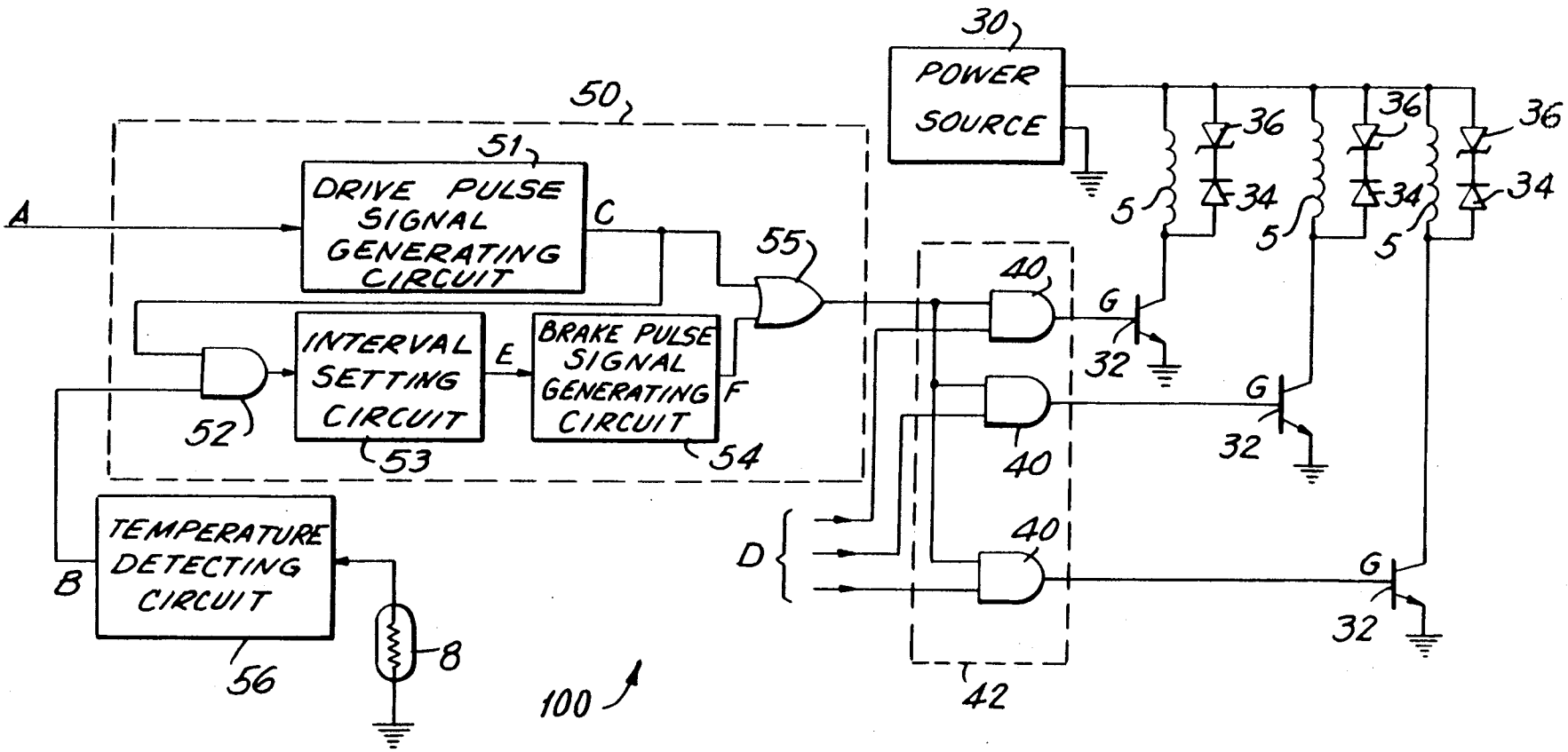
FIG. 2 is a block diagram of a print head driving circuit constructed in accordance with the present invention.

Reference is now made to FIG. 2, wherein a drive circuit, generally indicated as 100, constructed in accordance with the invention for driving print head 4 is provided. Each driving coil 5 is connected at a first terminal at one end to a DC power source 30. The other end at a second terminal of each driving coil 5 is connected to ground through the emitter-collection path of a switching transistor 32. A spark current absorbing circuit which includes a diode 34 and a voltage regulating diode 36 arranged in series is connected across driving coil 5. Voltage regulating diode 36 is connected between the first terminal of driving coil 5 and diode 34 in a forward biased direction relative to DC power source 30. Diode 34 is connected between the second terminal of actuator coil 5 and voltage regulating diode 36 in a reverse bias relative to DC power source 30.

An output circuit 42 includes a plurality of AND gates 40. The output of each respective AND gate 40 is input at the base of respective switching transistors 32. Each AND gate receives a first input corresponding to print data for selecting the respective driving coil 5 and a second input from a reference timing signal generating circuit 50.

Reference timing signal generating circuit 50 includes a drive pulse signal generating circuit 51 which receives a print timing pulse and produces a drive pulse signal in response thereto. An AND gate 52 receives the driving pulse signal and an output from a temperature detecting circuit 56 and provides a gated output in response thereto. An interval setting circuit 53 receives the output of AND gate 52 and provides an output to a brake pulse signal generating circuit 54. An OR gate 55 receives the drive pulse signal from drive pulse signal generating circuit 51 and the output of brake pulse signal generating circuit 54 and provides the gated output of timing signal generating circuit 50.

Driving pulse generating circuit 51 is adapted to output a pulse signal with a pulse width, for example 230 $\mu$s, which is necessary to drive print wire 7 in response to the print timing pulse. AND gate 52 receives the drive pulse signal and produces an output when the input from temperature detecting circuit 56 is high. Interval setting circuit 53 is provided with a pulse width $T_1$, for example 60 $\mu$s, set therein which corresponds to the time necessary for print wire 7 to return to its home position utilizing the print timing pulse as a reference point. Brake pulse signal generating circuit 54 is actuated at the falling edge of the pulse signal from an interval setting circuit 53, i.e., at the end of pulse interval $T_1$ and outputs a pulse having a pulse width $T_2$. Pulse width $T_2$ has a value, for example of 50 $\mu$s, to allow lever 6 and print wire 7 to be decelerated due to energization of driving coil 5 during the return stroke of print lever 6 to such an extent that no rebounding occurs even when the temperature of print head 4 or the temperature of damper 13 is outside of a predetermined range. The output of drive pulse signal generating circuit 51 and brake pulse signal generating circuit 54 are input to output circuit 42 through OR gate 5 to energize the respective driving coils 5.

Temperature detecting circuit 56 receives an input from temperature sensor 8 which detects the temperature of the print head. Temperature detecting circuit 56 is a window comparator which produces a low level (L) signal when the input from the temperature sensor is within a predetermined range, for example 5° C. to 70° C. or a high level signal (H) when the temperature falls outside of this predetermined range.

Figure 3:
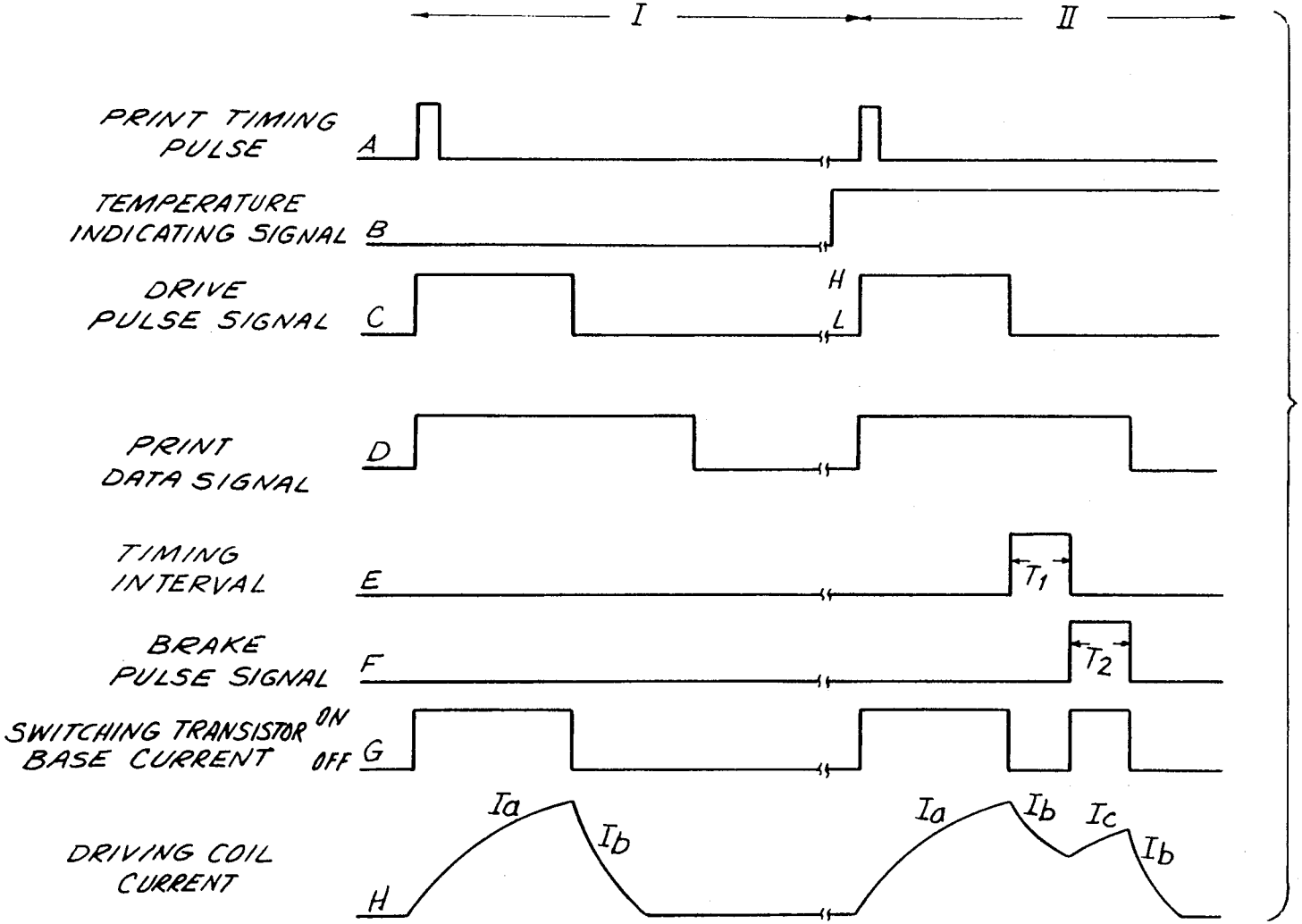
FIG. 3 is a waveform timing diagram for operation of the print head driving circuit of FIG. 2.

In FIG. 3, Section I corresponds to the operation of driving circuit 100 when the print head temperature is maintained within the predetermined range. When a print timing pulse A is input to drive pulse signal generating circuit 51, a drive pulse signal C is output. Driving pulse signal C has a pulse width which, when passed through OR gate 55, opens the AND gate 40 of output circuit 42 which is indicated by print data signal D. Print date signal D selects the print wire to be driven and is output for the print timing pulse A. AND gate 40 corresponding to the print wire which is to perform printing in accordance with print data D outputs a pulse G and transistors 32 synchronized with drive pulse signal C to turn switching transistor 32 ON. This causes current to be supplied from DC power source 30 to driving coil 5. This results in driving coil 5 being energized and attracting print lever 6 so that print wire 7 is moved towards the platen.

At the same time, drive pulse signal generating circuit 51 outputs drive pulse signal C to AND gate 52. However, since the temperature of print head 4 is maintained within the predetermined temperature range, temperature detecting circuit 56 delivers the low level (L) signal. Therefore, AND gate 52 produces no output. Consequently, interval setting circuit 53 and brake pulse signal generating circuit 54 are maintained in a non-operating state. The returning print wire 7, which has been moved toward platen 16, is now returned by return spring 12 biasing print lever 6 in a return direction. The resulting impact impulses are absorbed by damper 13 which stops print lever 6 in its original stationary position.

Section II of FIG. 3 illustrates the operation of driving circuit 100 when the temperature of print head 4 falls outside of the predetermined range. When the temperature of print head 4 becomes lower than the predetermined temperature range or higher than the predetermined temperature range, temperature detecting circuit 56 delivers a high level (H) signal temperature indicating signal D. When print timing pulse A is output, drive pulse signal generating circuit 51 outputs drive pulse signal C. The output of drive pulse signal generating circuit 51 causes a current $I_a$ to flow through driving coil 5 as it does in the normal operating state when print wire 7 is hammered onto platen 16. Drive pulse signal C is also input to AND gate 52 which now receives the high level (H) temperature indicating signal D opening AND gate 52 causing it to output drive pulse signal C to interval setting circuit 53; actuating interval setting circuit 53.

Figure 6:
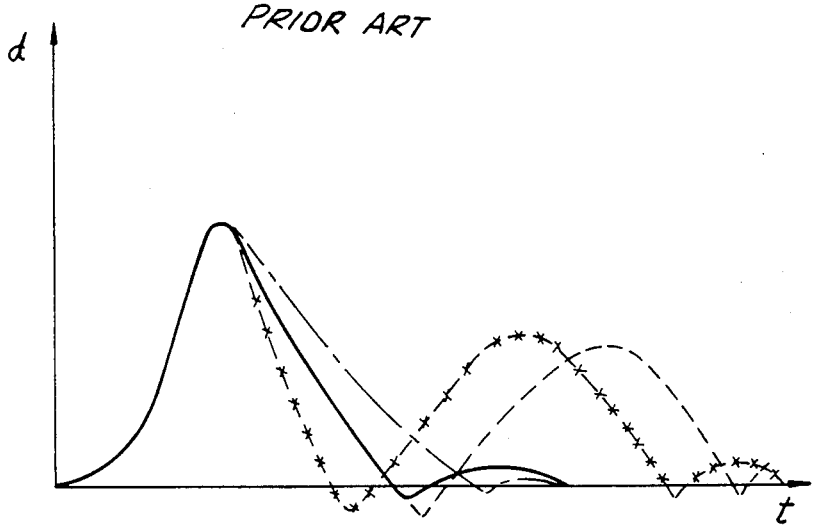
FIG. 6 PRIOR ART
FIG. 6 is a graph showing the motion of a print wire over time for print wires driven by both the prior art print head driving circuit and a print head driving circuit constructed in accordance with the invention.

At the end of drive pulse signal C, print wire 7 has been hammered onto platen 16 and is now beginning its return stroke movement. When the interval $T_1$ (E) set within interval setting circuit 53, triggered by the falling edge of drive pulse signal C elapses, brake pulse signal generating circuit 54 outputs the brake pulse signal (F) having a pulse width $T_2$. Print data signal D is still held within output circuit 42 so that when brake pulse signal generating circuit 54 provides a brake pulse signal (F), the transistor selected in accordance with the print data signal D is again turned ON with the input of brake pulse signal (F) through AND gate 40. This results in a current $I_c$ being caused to flow from DC power source 30 through driving coil 5, energizing driving coil 5. Therefore, print lever 6 which is returning to the home position, is now again attracted by driving coil 5 in the opposite direction to its present motion so that it is decelerated as it comes in contact with damper 13 while being damped and, therefore, moves as represented by the dotted chain line of FIG. 6. Therefore, even when the viscoelasticity of damper member 13 is lowered due to excessive heat or cold, print lever 6 is prevented from rebounding by being pressed against damper member 13 by urging spring 13 acting in cooperation with driving coil 5.

Figure 4:
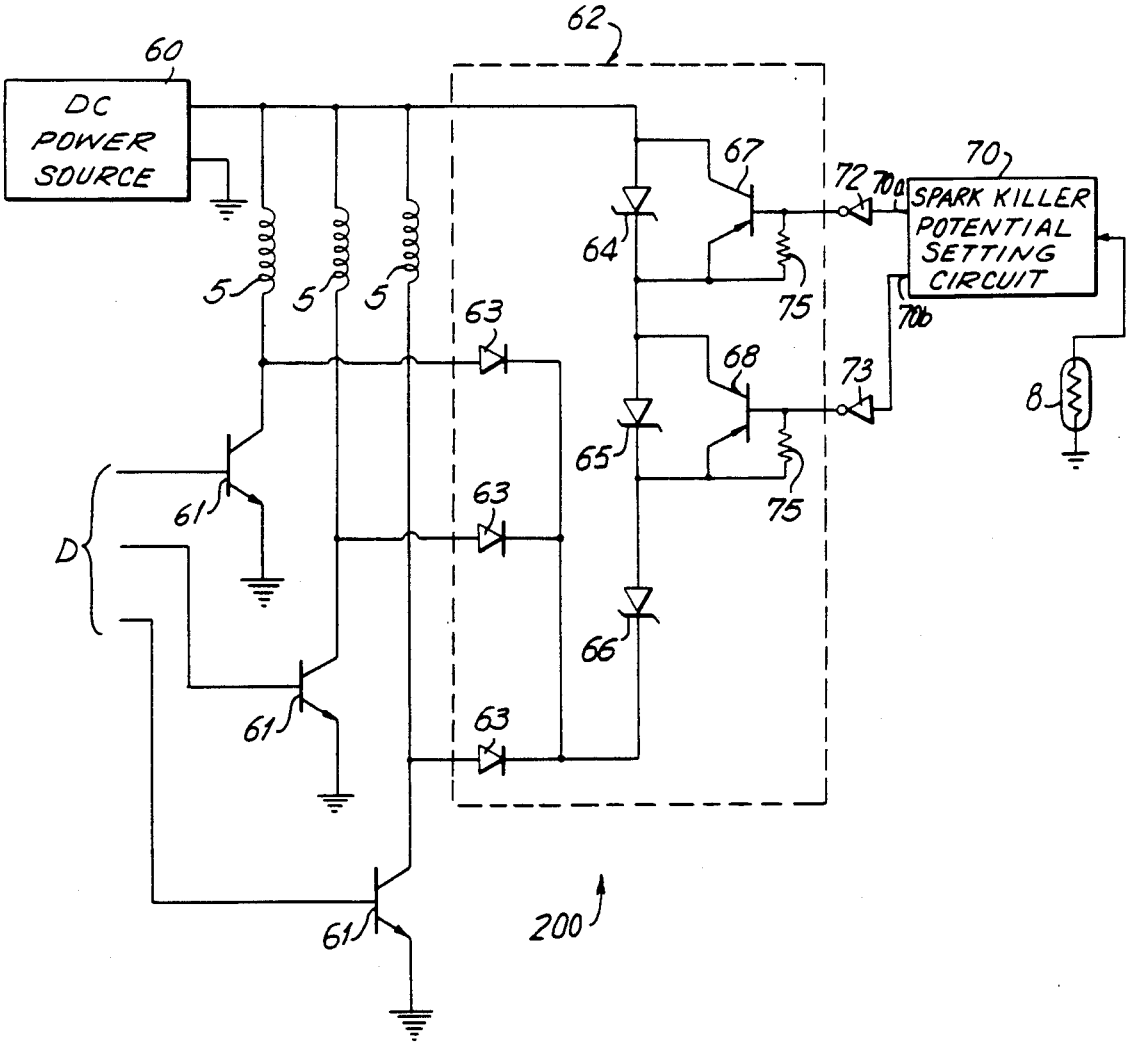
FIG. 4 is a block diagram of a print head driving apparatus constructed in accordance with as second embodiment of the invention.

Reference is now made to FIG. 4 in which a driving circuit, generally indicated at 200, constructed in accordance with a second embodiment of the invention, is provided. Each driving coil 5 for moving print lever 6 is connected at a first terminal to a DC power source 60. Driving coil 5 is connected to ground at a second terminal through a respective switching transistor 61. The second terminal of each driving coil 5 is connected to DC power source 60 through a spark killer circuit 62.

Spark killer circuit 62 includes a plurality of voltage regulating diodes 64, 65, 66 connected in series with a forward bias with respect to DC power source 60. The first end of the series combination, i.e., the anode of voltage regulating diode 64 is connected to DC power source 60. The second end of the series combination, i.e., the cathode of voltage regulating diode 66, is connected at the junction of each driving coil 5 with its respective switching transistor 61 through a corresponding diode 63. Each diode 63 is in a reverse bias with respect to DC power source 60. A first switching transistor 67 is connected with its emitter-collection path across voltage regulating diode 64 and a second switching transistor 68 is connected with its emitter-collector path across voltage regulating diode 65. A resistor 75 provides a feedback between the base of each switching transistor 67, 68 and the emitter of the associated transistor.

A spark killer potential setting circuit 70 is coupled to temperature sensor 8 and receives an input signal therefrom. Spark killer potential setting circuit 70 outputs a high level (H) signal through a first output terminal **70*a* to the base of first switching transistor 67 and a second output terminal 70*b* to the base of second switching transistor 68 when the input signal indicates the sensed temperature is within the normal temperature range. Output terminal 70*a* is coupled to the base of transistor 67 through an invertor 72. Output terminal 70*b* is connected to the base of switching transistor 68 through an invertor 73. Spark killer potential setting circuit 70 produces a high level signal (H) from first output terminal 70*a* when the temperature is lower than the predetermined temperature range and produces the high level signal (H) from both first output terminal 70*a* and second output terminal 70*b*** when the temperature is higher than the upper limit of the predetermined temperature range.

Figure 5:
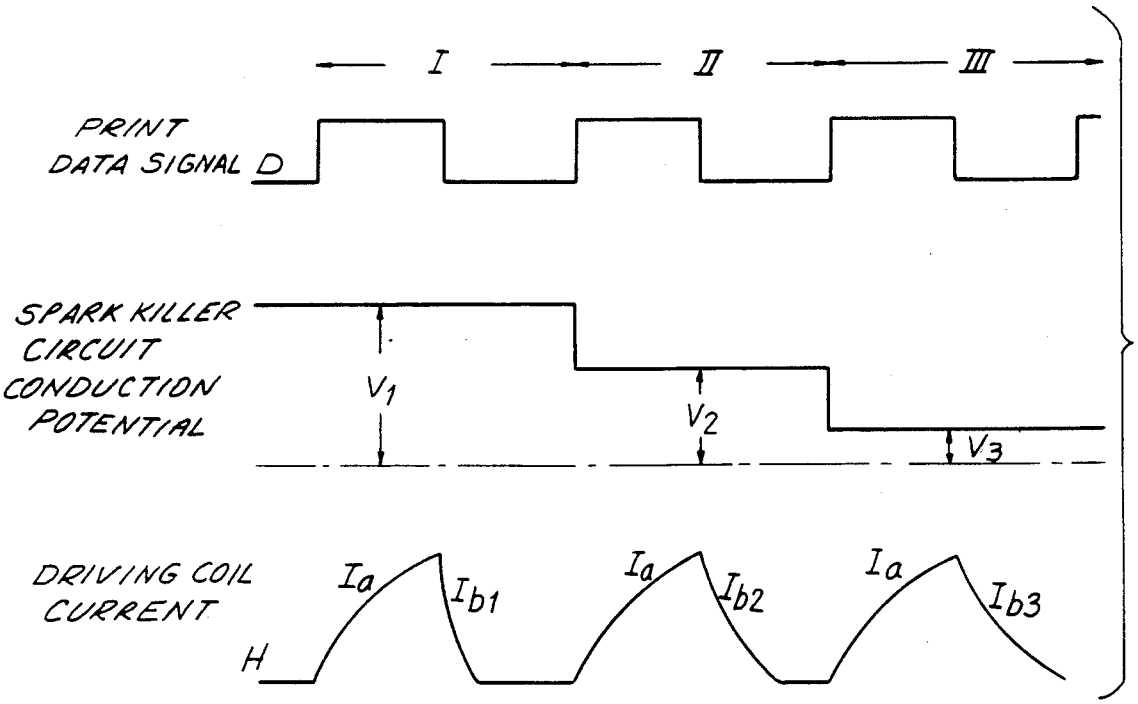
FIG. 5 is a waveform timing diagram for operation of the print head driving circuit of FIG. 4.

Reference is now made to FIG. 5 in which the timing waveforms for operating driving circuit 200 are provided. As seen in portion I of the FIG. 5 corresponding to operation of driving circuit 200 within the predetermined temperature range, a print data signal D is input to the switching transistor 61 corresponding to the print wire to be actuated. This allows driving coil 5 to be supplied with DC current $I_a$ from DC power supply 60, energizing driving coil 5 so that print lever 6 is attracted towards driving coil 5 causing print wire 7 to hammer into platen 16. When the print data signal is turned OFF, driving coil 5 dissipates its electromagnetic energy generating a counter-electromotive force. In an early stage of the print operation, since the potential of counter-electromotive force is greater than the conduction potential of spark killer circuit 62, a flywheel current $I_{b1}$ is generated within driving coil 5 which aids print lever 6 in moving towards platen 16. When the hammering operation is completed, the counter-electromotive force becomes lower in potential than the conduction potential $B_1$ input to the spark killer potential setting circuit 70 where the flywheel current $I_{b1}$ quickly terminates. Print lever 6 begins to return towards the damper member from the urging force of return spring 12. Because the temperature of print head 4 is maintained within the predetermined temperature range, insuring a sufficient viscoelasticity for damper 13, even when flywheel current $I_{b1}$ quickly terminates, viscoelasticity of damper 13 is sufficient to absorb the kinetic energy impulse of the returned print lever 6, thereby preventing print lever 6 and print wire 7 from rebounding.

Reference is now made to Section II which illustrates operation of driving circuit 200 when the temperature of print head 4 is below the predetermined range. Spark killer potential setting circuit 7 outputs a high level signal (H) from first output terminal 70*a* to place switching transistor 64 in a conductive state. As a result, the conduction potential $V_2$ of spark killer circuit 62 is lowered by the zener voltage of voltage regulating diode 64. When the data signal D is applied to switching transistor 61 corresponding to the associated print wire to be actuated, DC current from DC power source 60 is input to driving coil 5 energizing driving coil 5 so that print lever 6 is attracted towards driving coil 5 causing print wire 7 to hammer onto platen 16.

When print data signal D turns OFF, driving coil 5 dissipates its electromagnetic energy generating a counter-electromotive force. During an early print stage, since the counter-electromotive force potential is greater than the conduction potential $V_2$ of spark killer circuit 62, flywheel current $I_{b2}$ is generated in driving coil 5 which assists in moving print lever 6. When print wire 7 has completed its hammering into platen 16, print lever 6 begins to return towards damper member 13 under the influence of the urging force of return spring 12. However, because conduction potential $V_2$ of spark killer circuit 62 is caused to be low due to the zener voltage of voltage regulating diode 64, when compared with operation at a normal temperature, the flywheel current still flows through driving coil 5 even during the return stroke of lever 6. Therefore, driving coil 5 maintains an attractive force urging print lever 6 towards platen 16 so the return action of print lever 6 is braked. Therefore, when the viscoelasticity of damper 13 is lowered due to an extreme decrease in temperature, damper 13 is still able to absorb the impulse of print lever 6 which has been decelerated by the attractive force of driving coil 5. Accordingly, print lever 6 and print wire 7 are stopped at the proper position without rebounding.

Reference is now made to Section III of FIG. 5 illustrating operation of driving circuit 200 when the temperature of print head 4 increases beyond the predetermined temperature range due to high density printing or the like. Spark killer potential setting circuit 70 outputs high level (H) signals through first output terminal 70*a* and second output terminal 70*b* causing both switching transistor 67 and switching transistor 68 to be in a conductive state. This results in the conduction potential $V_3$ of spark killer 62 to be even further lowered by the sum of zener voltages of the voltage regulating diode 64, 65.

When the print data signal is input to switching transistor 61 corresponding to the desired print wire 7 to be actuated, a DC current from DC power supply 60 is input to driving coil 5, energizing driving coil 5, attracting print lever 6, causing print wire 7 to be hammered into platen 16. When print data signal D is turned OFF, driving coil 5 dissipates its electromagnetic energy generating a counter-electromotive force. During an early stage of printing, since the counter-electromotive force potential is greater than the conduction potential of spark killer circuit 62, flywheel current $I_{b3}$ is generated in driving coil 5 aiding the motion of lever 6.

When the hammering of print wire 7 into platen 16 is completed, print lever 6 moves toward damper 13 under the influence of the urging force of return spring 12. However, since the conduction potential $V_3$ of spark killer circuit 62 is set to be lower corresponding to the sum of zener voltages of the two voltage regulating diodes 64, 65, as compared with the operation of driving circuit 200 within the normal temperature range, flywheel current $I_{b3}$ still flows through driving coil 5 even during the return stroke of print lever 6. Therefore, driving coil 5 maintains its attractive force over a longer period of time at a decreased level urging lever 6 towards platen 16 so that the return motion of print lever 6 is braked over a long time period. Therefore, even when the viscoelasticity of damper 13 has been extremely reduced due to an increase in temperature, damper 13 absorbs the impulse of print lever 6 which has been decelerated by the attractive force of driving coil 5 so that print lever 6 and print wire 7 are stopped at a proper initial position without rebounding.

Although driving circuit 200 has been described in which the conduction potential is changed to a greater extent when the temperature of the print head exceeds the upper limit than when it exceeds the lower temperature limit, the same effect may be obtained even if the conduction potential is changed by a substantially equal extent for both cases where the material of the damper permits. It also follows that even though driving circuit 200 has been described with the decrease of viscoelasticity of the damper when the temperature of the print head exceeds the upper limit of the predetermined temperature range being larger than when it exceeds the lower limit, that where the decrease of viscoelasticity is larger when the temperature of the print head exceeds the lower limit it is possible to set the conduction potential lower when the temperature exceeds this lower limit.

The above invention provides a drive circuit for driving a wire dot type print head which includes a lever for causing the print wire to hammer onto a platen through the attraction of a driving coil and a spring member for urging the lever to a stand-by position after striking has occurred. A damper member for absorbing the kinetic energy of the lever during the return stroke of the print lever is provided and current is caused to flow to the driving coil during the return stroke of the print wire. The amount of current which flows to the driving coil is dependent upon the output of the temperature detector so that the print lever is braked during the return stroke by the magnetic attractive force generated even when the temperature of the print head falls outside a predetermined range, thereby lowering the viscoelasticity of the damper, the return impulse of the print lever may be sufficiently reduced so that rebounding within the print wire can be reliably prevented. By providing a temperature sensor which triggers a delayed input to the driving coil only when the temperature of the print head falls outside a predetermined temperature range current is caused to flow to the driving coil during the return stroke and, as a result, the magnetic attractive force generated by that current acts on the lever during the return stroke to brake the lever so that the proper motion of the print wire is provided regardless of the temperature of the print head or the viscoelasticity of the damper.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A drive circuit for driving a wire dot print head having a plurality of driving coils, each driving coil having a first end and a second end, a print lever movably mounted within said print head to move in a first direction and a second direction, the driving coil selectively applying an attractive force on the print lever to move the print lever in the first direction, in response to a print data signal and a print timing pulse signal, a biasing device for biasing the print lever to a stand-by position in a second direction opposed to said first direction, and a damper for absorbing the kinetic energy of the print lever when said print lever moves in said second direction to the stand-by position, comprising:

DC power source means connected to the first end of the driving coil;

at least one switching means connected to the second end of each driving coil;

reference timing signal generating means for producing a first output signal;

output gate means for providing a second output signal to the switching means in response to the print data signal and first output signal from the reference timing signal generating means, the second output signal causing a selected driving coil to apply a force to said print lever in the first direction; and reference timing signal generating means including a drive pulse signal generating means which outputs a drive pulse signal in response to the print timing pulse signal and a brake pulse generating means which outputs a brake signal to said output gate means causing the selected driving coil to apply a force to said print lever in the first direction when the temperature of the print head falls outside of a predetermined temperature range and said print lever is moving in said second direction.

2. The drive circuit of claim 1, further comprising temperature detecting means for determining when the temperature of the print head falls outside of said predetermined temperature range and outputting a temperature indicating signal to said brake generating means, the brake signal generating means producing the brake signal in response thereto.

3. The drive circuit of claim 1, wherein said temperature detecting means includes a thermistor.

4. The drive circuit of claim 1, wherein the viscoelasticity of the damper changes when the temperature of the print head falls outside of the predetermined temperature range.

5. The drive circuit of claim 1, wherein the output means includes a plurality of AND gates, each AND gate being coupled to a respective driving coil through a respective switching means.

6. The drive circuit of claim 1, wherein said switching means includes a transistor.

7. The drive circuit of claim 2, wherein said reference timing signal generating means further includes an OR gate, the drive pulse signal generating means providing a drive pulse signal to said OR gate at one input of said OR gate and said brake pulse signal generating means providing a second input of said OR gate, said OR gate providing an input to said output gate means.

8. The drive circuit of claim 7, wherein said reference timing signal generating means further comprises an interval setting circuit and an AND gate, said AND gate receiving the drive pulse signal as a first input and the temperature indicating signal as a second input and providing an output to said interval setting circuit when both inputs of said AND gate are a high level signal, said interval setting circuit outputting a delayed signal to said brake pulse signal generating circuit having a given interval causing said brake pulse signal generating circuit to produce an output during the movement of said print lever in the second direction.

9. A drive circuit for driving a wire dot print head, having a plurality of driving coils, each driving coil having a first end and a second end, a print lever movably mounted within the print head, the driving coil selectively applying an attractive force on the print lever in a first direction in response to a print data signal and a print timing pulse signal, a biasing device for urging the lever to a stand-by position in a second direction opposed to said first direction, and a damper for absorbing kinetic energy of the print lever when said print lever moves in said second direction to the stand-by position, comprising:

DC power source means connected to the first end of the driving coil;

switching means connected to the second end of each of said driving coils, said switching means receiving a print data signal and turning ON and OFF in response to the print data signal, the driving coil biasing said print lever in the first direction when said switching means is turned ON;

spark killer means connected to the DC power source means;

at least a first diode connecting said spark killer means to each driving coil, the diode being disposed in reverse bias when viewed from the DC power source; and spark killer potential setting means for setting the conduction potential of said spark killer means in response to the temperature of the print head so that said driving coil to supply a force to said print lever in the first direction when said print level is moving in the second direction when the temperature of said print head falls outside of a predetermined temperature range.

10. The drive circuit of claim 9, wherein the spark killer potential setting means sets the conduction potential of said spark killer means at a first level when the temperature of the print head falls within the predetermined range.

11. The drive circuit of claim 10, wherein the spark killer potential setting means sets the conduction potential of said spark killer means at a second level, the second level being less than said first level, when the temperature of the print head falls below the predetermined temperature range.

12. The drive circuit of claim 11, wherein the spark killer potential setting means sets the conduction potential of said spark killer means at a third level, the third level being less than said second level, when the temperature of the print head rises above the predetermined temperature range.

13. The drive circuit of claim 9, wherein the viscoelasticity of the damper member decreases when the temperature of the print head falls outside of the predetermined temperature range.

14. The drive circuit of claim 10, wherein said spark killer means comprises a plurality of voltage regulating diodes coupled in series between the DC power source means and the second end of each driving coil and a plurality of second switching means for connecting said spark killer potential setting means to said voltage regulating diodes.

15. The drive circuit of claim 9, wherein said switching means includes a transistor.

16. The drive circuit of claim 9, further comprising temperature sensing means connected to said spark killer potential setting means for producing an output corresponding to the temperature of the print head.

* * * * *